US006053987A

United States Patent [19]

Tanimura et al.

[11] Patent Number: 6,053,987

[45] Date of Patent: Apr. 25, 2000

[54] METHOD AND AN APPARATUS FOR CLEANING A FLAME DETECTOR OF A COMBUSTOR

[75] Inventors: Satoshi Tanimura; Yoshifumi Masuda; Fuminori Fujii, all of Hyogo-ken, Japan

[73] Assignee: Mitsubishi Heavy Industries, Ltd., Tokyo, Japan

[21] Appl. No.: 09/035,508

[22] Filed: Mar. 5, 1998

[51] Int. Cl.[7] ..... B08B 7/04; F02C 6/18; F02D 1/00; F01C 1/00; F01N 1/18

[52] U.S. Cl. ..... 134/37; 60/39.07; 60/900; 60/901; 60/902

[58] Field of Search ..... 134/37; 60/900, 60/901, 902, 39.07

[56] References Cited

U.S. PATENT DOCUMENTS

| | | | |
|---|---|---|---|
| 4,860,533 | 8/1989 | Joshi | 60/39.06 |
| 5,103,629 | 4/1992 | Mumford et al. | 60/39.06 |
| 5,351,489 | 10/1994 | Okamoto et al. | 60/740 |
| 5,802,841 | 9/1998 | Maeda | 60/39.07 |

FOREIGN PATENT DOCUMENTS

| | | |
|---|---|---|
| 61-231326 | 10/1986 | Japan . |
| 63-263427 | 10/1988 | Japan . |
| 94-093882 | 4/1994 | Japan . |

*Primary Examiner*—Randy Gulakowski
*Assistant Examiner*—Yolanda E. Wilkins
*Attorney, Agent, or Firm*—John P. White; Cooper & Dunham LLP

[57] ABSTRACT

A cleaning method for a flame detector of a gas turbine activating combustor, comprising branching control air for forcing a spark plug of an ignition system into the gas turbine activating combustor, and blowing the branched control air against the respective inner surfaces of light sensor glasses of a flame detector, thereby blowing off dust or soot from the glass.

2 Claims, 3 Drawing Sheets

METHOD AND AN APPARATUS FOR CLEANING A FLAME DETECTOR OF A COMBUSTOR

BACKGROUND OF THE INVENTION

The present invention relates to a method and an apparatus for cleaning a flame detector applicable to a gas turbine activating combustor.

Among typical ignition systems of gas turbines, there is a spark-ignition system in which high-voltage current is used to fly sparks in a gap of a spark plug, thereby firing atomized fuel. FIG. 2 shows a system diagram of the ignition system.

Referring to FIG. 1, there is shown a four-port solenoid valve 11, which is energized by means of a valve driver 11*a* in response to a command for firing, whereupon control air 10 is fed from a forcing air system 12 into an air cylinder 13. As this is done, a spark plug 14 is inserted into an inner cylinder of a combustor (not shown). At the same time, atomized fuel is ejected from a spray jet of a fuel nozzle, while fuel atomizing air is blown out from around the fuel nozzle.

When ignition is completed, ignition transformer operation is canceled, and the solenoid valve 11 is de-energized, so that the control air 10 is fed into a drawing air system 15, and the air cylinder 13 is returned to its original position. Thereupon, the spark plug 14 is drawn out of the inner cylinder of the combustor.

The spark plug 14 is inserted into and drawn out from the inner cylinder of the combustor in order to prevent the plug 14 from burning in a high-temperature combustion gas. The pressure of the control air 10 for controlling the spark plug 14 ranges from about 4 to 10 kgf/cm$^2$.

Referring now to FIG. 2, a conventional flame detector 16 for detecting firing by means of the ignition system will be described. The detector 16 is attached to each side of the spark plug 14 of the combustor. As shown in FIG. 2, a light sensor glass 17 is provided on the combustor side of the flame detector 16, whereby the intensity of received light is detected.

In the case where the conventional flame detector is used in a PFBC (pressurized-fluid-bed combined power plant) or IGCC in which coal fuel is used for single-fuel firing, dust, soot, etc. are deposited on the light sensor glasses of the flame detector during operation, sometimes inhibiting flame detection in the next cycle.

Thus, the conventional flame detector requires dismantling for glass cleaning once a week or every several weeks.

BRIEF SUMMARY OF THE INVENTION

The object of the present invention is to provide a method and an apparatus for cleaning a flame detector of a combustor, whereby cleaning the flame detector, which conventionally is required once a week or every several weeks, can be omitted to save labor, and which ensure reliable confirmation of firing at low equipment cost.

A cleaning method for a flame detector of a gas turbine activating combustor according to the present invention comprises: branching control air for forcing a spark plug of an ignition system into the gas turbine activating combustor; and blowing the branched control air against the respective inner surfaces of light sensor glasses of a flame detector, thereby blowing off dust or soot from the glasses.

In igniting a fuel in the gas turbine activating combustor, the spark plug of the ignition system is kept in the combustor by the control air until the fuel is fired. Further, the control air is branched and blown against the respective inner surfaces of the light sensor glasses. The moment the ignition operation for the fuel in the combustor is started, therefore, the control air can be blown against the sensor glass surfaces to remove dust or soot therefrom. Thus, the flame detector can securely detect firing.

A cleaning apparatus for a flame detector of a gas turbine activating combustor according to the present invention comprises: a branched air system diverging from a forcing air system for supplying control air to an air cylinder for forcing a spark plug of an ignition system into the gas turbine activating combustor; and air bleeding means for blowing the branched control air against the respective inner surfaces of light sensor glasses of a flame detector.

In this arrangement, the spark plug of the ignition system is forced into the gas turbine activating combustor by supplying the control air to the air cylinder. Some of the control air is bled by the branched air system and the air bleeding means and blown against the respective surfaces of the light sensor glasses, so that the flame detector can securely detect firing.

Additional objects and advantages of the invention will be set forth in the description which follows, and in part will be obvious from the description, or may be learned by practice of the invention. The objects and advantages of the invention may be realized and obtained by means of the instrumentalities and combinations particularly pointed out in the appended claims.

BRIEF DESCRIPTION OF THE SEVERAL VIEWS OF THE DRAWING

The accompanying drawings, which are incorporated in and constitute a part of the specification, illustrate presently preferred embodiments of the invention, and together with the general description given above and the detailed description of the preferred embodiments given below, serve to explain the principles of the invention.

DETAILED DESCRIPTION OF THE INVENTION

Figure 1:
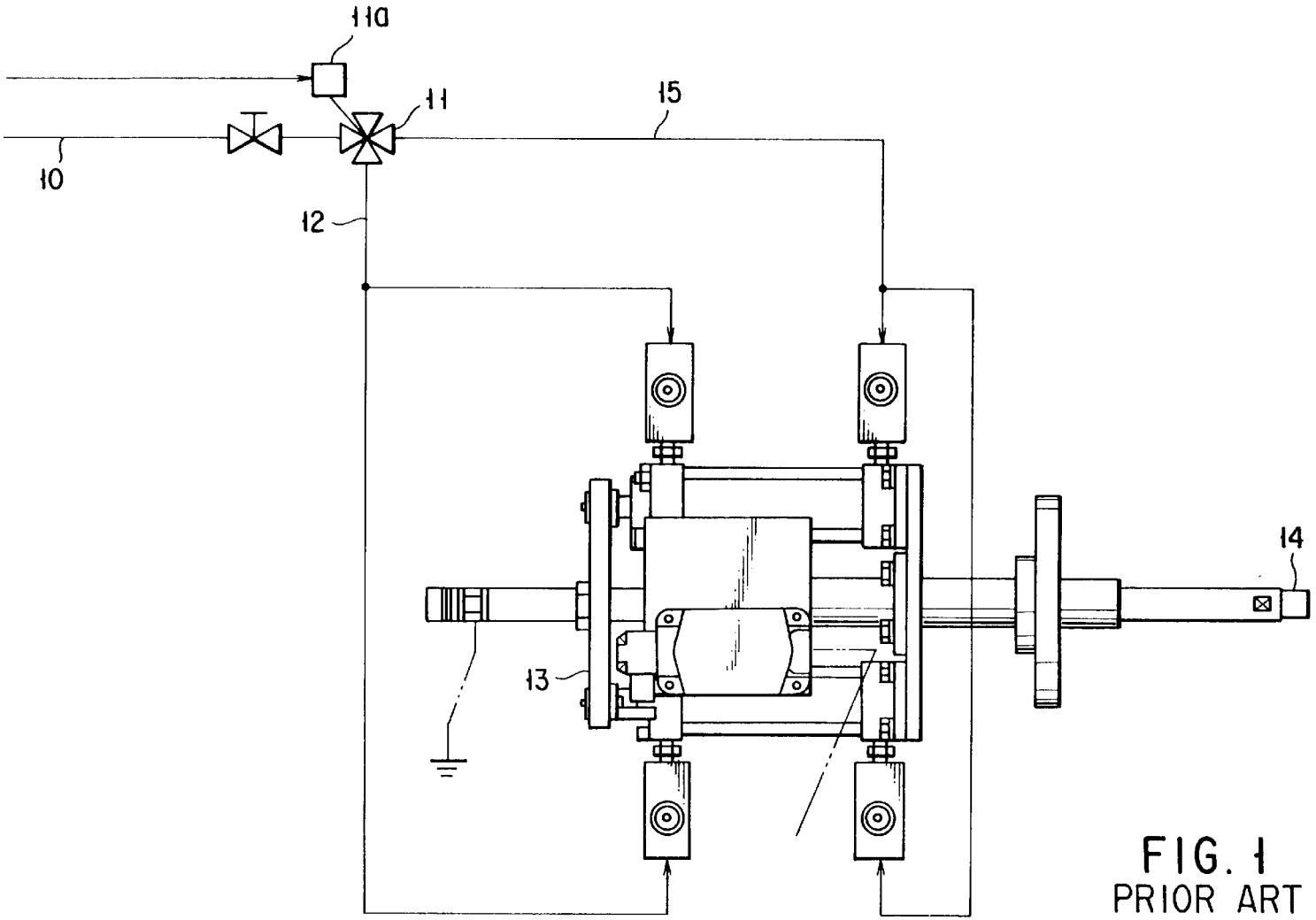
FIG. 1 PRIOR ART
FIG. 1 is a diagram illustrating a conventional ignition system.
Figure 2:
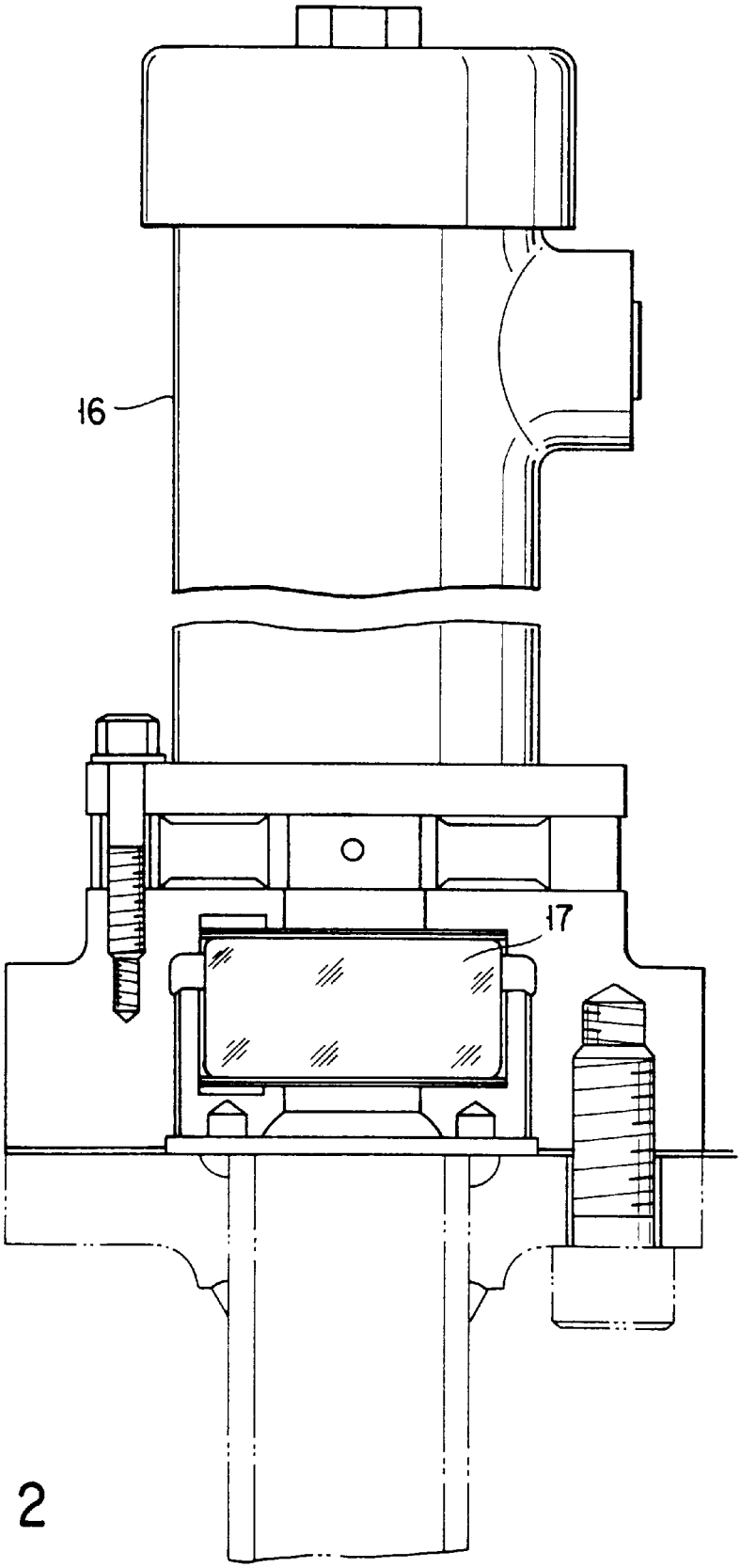
FIG. 2 is a diagram illustrating a conventional flame detector.
Figure 3:
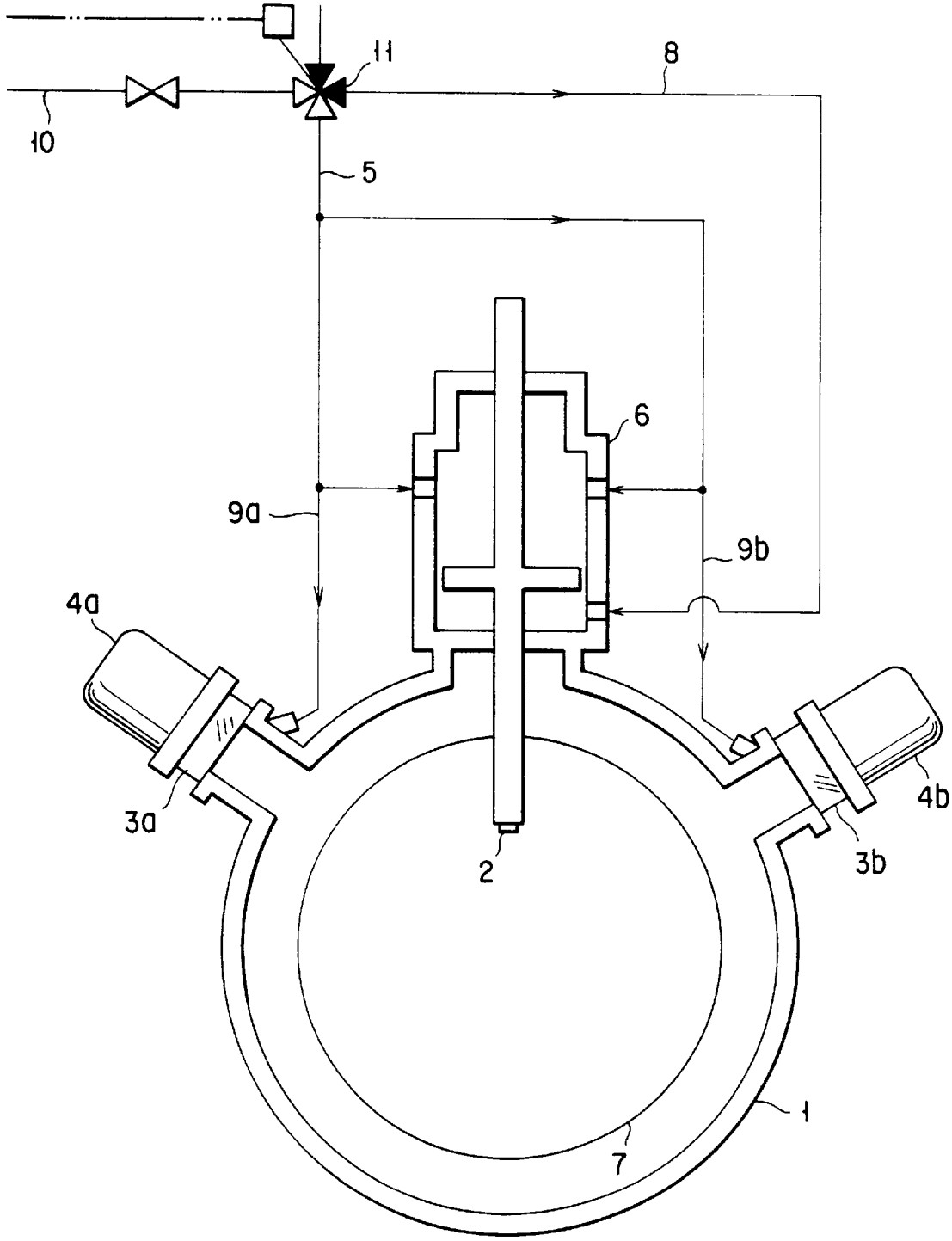
FIG. 3 is a diagram illustrating a cleaning apparatus for a flame detector of a combustor according to an embodiment of the present invention.

Referring now to FIG. 3, a cleaning apparatus for a flame detector of a combustor according to an embodiment of the present invention will be described. The cleaning method and cleaning apparatus according to the present embodiment shown in FIG. 3 are applied to a gas turbine activating combustor 1. The combustor 1, which has an inner cylinder 7 therein, is connected with a forcing air system 5 and a drawing air system 8 to which control air 10 is alternatively supplied through a valve controller 11*a* and a four-port solenoid valve 11. An air cylinder 6 is provided outside the combustor 1. The cylinder 6 is supplied with the control air through the forcing or drawing air system 5 or 8. The air cylinder 6 serves to insert into or draw out a spark plug 2 from the inner cylinder 7.

As shown in FIG. 3, the cleaning apparatus according to the present embodiment is provided on each of two sides of the combustor 1. Each cleaning apparatus is composed of a light sensor glass 3*a* or 3*b*, a flame detector 4*a* or 4*b* for detecting a flame in the combustor 1 through its corresponding glass 3*a* or 3*b*, and a cleaning air supply line 9*a* or 9*b* connected to the forcing air system 5. Cleaning air is supplied through the lines 9*a* and 9*b* and blown against the respective surfaces of the sensor glasses 3*a* and 3*b*. The cleaning air supply lines 9*a* and 9*b* constitute a branched air system and air bleeding means for bleeding the control air 10 from the forcing air system 5 so that the bleed air is used as cleaning air.

When the four-port solenoid valve 11 is energized to deliver the control air 10 from the forcing air system 5 to the forcing side of the air cylinder 6, the spark plug 2 is inserted into the inner cylinder 7 of the combustor 1. At the same time, the control air 10 is also blown against the respective inner surfaces of the light sensor glasses 3*a* and 3*b* of the flame detector 4, thereby blowing off dust or soot from the glasses 3*a* and 3*b*.

When ignition is completed, ignition transformer operation is canceled, and the solenoid valve 11 is de-energized, so that the supply system for the control air 10 is switched from the forcing air system 5 to the drawing air system 8. Thereupon, the air cylinder 6 is returned to its original position, and the spark plug 2 is drawn out of the inner cylinder 7. At the same time, the air supply to the light sensor glasses 3*a* and 3*b* is stopped.

The control air 10 is kept at a pressure of about 4 to 10 $kgf/cm^2$, which is a suitable air pressure just high enough to blow off dust or soot from the light sensor glasses 3*a* and 3*b*. Further, the control air 10 is blown against the surfaces of the glasses 3*a* and 3*b* as the spark plug 2 is forced into the inner cylinder 7 to effect ignition. Thus, firing can be detected securely.

Since the cleaning air supply lines 9*a* and 9*b* are formed diverging from the forcing air system 5, moreover, the surfaces of the light sensor glasses 3*a* and 3*b* can be cleaned at low equipment cost without using any special equipment.

According to the cleaning method and apparatus of the present invention described herein, the control air to be supplied to the air cylinder, in order to force the spark plug of an ignition system into the gas turbine activating combustor, is caused to diverge by the air bleeding means, and is blown against the inner surfaces of the light sensor glasses of the flame detector. By doing this, dust or soot on the sensor glasses can be blown off and removed. Thus, cleaning the flame detector, which conventionally is required once a week or every several weeks, can be omitted. In consequence, the method and apparatus of the invention are laborsaving, and ensure reliable confirmation of firing at low equipment cost.

Additional advantages and modifications will readily occur to those skilled in the art. Therefore, the invention in its broader aspects is not limited to the specific details and representative embodiments shown and described herein. Accordingly, various modifications may be made without departing from the spirit or scope of the general inventive concept as defined by the appended claims and their equivalents.

What is claimed is:

1. A cleaning method for a flame detector of a gas turbine activating combustor, comprising:

branching control air for forcing a movable spark plug into the gas turbine activating combustor; and blowing the branched control air against surfaces of light sensor glasses of a flame detector, thereby blowing off dust or soot from the glass.

2. A cleaning apparatus for a gas turbine activating combustor flame detector, comprising:

a spark plug to be moved by an air cylinder;

a control air system for supplying air to the air cylinder, to thereby push the spark plug into the gas turbine activating combustor;

a branched air system branching from the control air system; and blowing means for making air from the branched air system blow onto light sensor glasses.

* * * * *